United States Patent [19]

Bräuning

[11] Patent Number: 4,880,272

[45] Date of Patent: Nov. 14, 1989

[54] SEAT FURNITURE

[75] Inventor: Egon Bräuning, Weil am Rhein, Fed. Rep. of Germany

[73] Assignee: Protoned B.V., Amsterdam, Netherlands

[21] Appl. No.: 202,222

[22] Filed: Jun. 3, 1988

[30] Foreign Application Priority Data

Jun. 9, 1987 [CH] Switzerland ..... 2161/87

[51] Int. Cl.[4] ..... A47C 3/00

[52] U.S. Cl. ..... 297/296; 297/297; 297/298

[58] Field of Search ..... 297/296, 297, 298, 299, 297/300, 301, 285, 353

[56] References Cited

U.S. PATENT DOCUMENTS

| | | | |
|---|---|---|---|
| 169,065 | 10/1875 | Tostevin | 297/298 |
| 2,439,869 | 4/1948 | Sharp | 297/296 |
| 2,557,671 | 6/1951 | McDonald | 297/299 X |
| 2,961,035 | 11/1960 | Lorenz | 297/85 |
| 3,095,238 | 6/1963 | Tarascon | 297/306 |
| 4,668,012 | 5/1987 | Hermann | 297/300 |

FOREIGN PATENT DOCUMENTS

| | | | |
|---|---|---|---|
| 147750 | 7/1936 | Austria | 297/296 |
| 88021 | 10/1895 | Fed. Rep. of Germany . | |
| 675688 | 5/1939 | Fed. Rep. of Germany | 297/297 |
| 832053 | 7/1949 | Fed. Rep. of Germany | 297/296 |

*Primary Examiner*—James T. McCall

*Attorney, Agent, or Firm*—Ralph W. Selitto, Jr.

[57] ABSTRACT

A seat (2) is mounted pivotably about a first axle (A1) on the stand (1) of the chair. The seat frame (8) is connected to a second axle (A2) which is fastened to the backrest (3) behind the backrest (3) at a horizontal distance from the latter and at a vertical distance from the first axle (A1).

The backrest (3) produced from an elastically resilient material, when deflected out of its vertical position, causes the second axle (A2) to move over an arc of a circle of radius $A_1$–$A_2$; the rear seat portion adjacent to the backrest (3) is also lowered correspondingly thereby. The backrest (3) extending over the entire height of the chair forms with its lower portion an integral component of the chair stand (1).

In comparison with the known complicated and heavy backrest/seat adjustment mechanisms, a cost-effective and lightweight construction, but one which fully satisfies modern ergonomic requirements as regards sitting comfort, is proposed here.

9 Claims, 2 Drawing Sheets

SEAT FURNITURE

Figure 2:
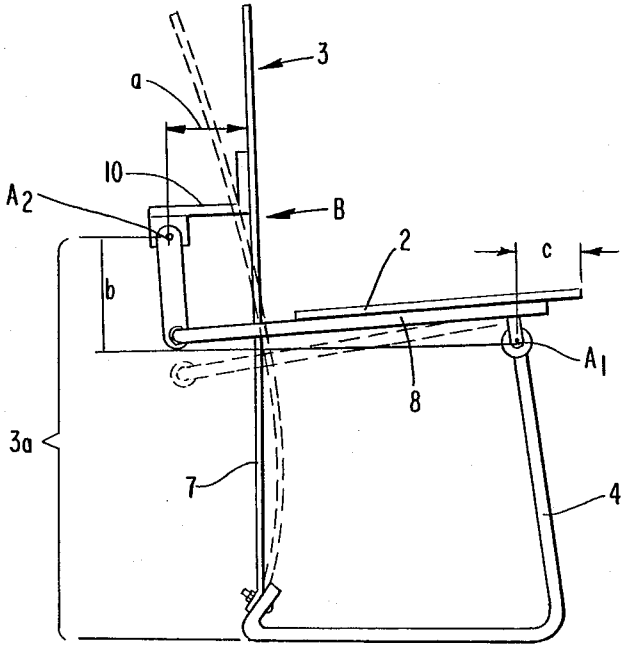

The invention relates to a seat furniture according to the pre-characterizing clause of the independent patent claim.

It is a known fact that sitting in a specific sitting position for a relatively long time soon causes fatigue, and that every seated person therefore generally tends to vary his position from time to time. Although these changes of position involve primarily the angular adjustment of the backrest, it has nevertheless been shown that any rearward pivoting of the backrest should be in conjunction with a corresponding adjustment of the seat, if it is not to lead to an ergonomically unacceptable position. According to experience, only in this way is it possible for the human body, when seated, to be supported in such a way that it can sit for a relatively long time without fatigue in all the possible positions of the backrest.

The design of the seat-surface/backrest adjustment mechanism made necessary because of this has already given rise to numerous constructions which therefore all have the aim of lowering the rear seat portion adjacent to the backrest by an appropriate amount during the rearward pivoting of the backrest, so that the seated person does not risk slipping forwards in the new position. However, these known constructions are based entirely on the use of lever mechanisms with steel springs and/or pneumatic springs, so that the chairs known at the present time and meeting the abovementioned criteria are not only complicated in terms of construction, but also costly and relatively heavy.

The object of the present invention is to provide a seat furniture of the type described in the introduction, which on the one hand, although having the coupling of the adjusting movements of the seat and backrest desirable for ergonomic reasons, nevertheless, on the other hand, makes do without the known expensive and heavy adjusting and catching mechanisms. At the same time, the functional coupling of the seat and backrest, referred to as "synchronous" in the art, is, if possible, to be achieved so that, on the one hand, the rear seat-surface portion adjacent to the backrest is lowered only when the seated person presses the backrest rearwards and, on the other hand, the backrest maintains its vertical position, irrespective of the load to which the seat surface is subjected, as long as there is no direct exertion of force on the latter.

This object is achieved by means of the feature combination which is defined in the characterizing clause of the independent Patent claim 1 and which is based on the surprising perception that the functions of the known adjusting mechanisms can be incorporated in the basic chair parts, namely the stand, seat and backrest, in such a way as to result in a cost-effective and lightweight seat furniture which can completely satisfy the known ergonomic requirements as regards sitting comfort, without being burdened with the disadvantages of the known mechanisms.

Some exemplary embodiments of the subject of the invention are described below with reference to the accompanying drawing.

Figure 1:
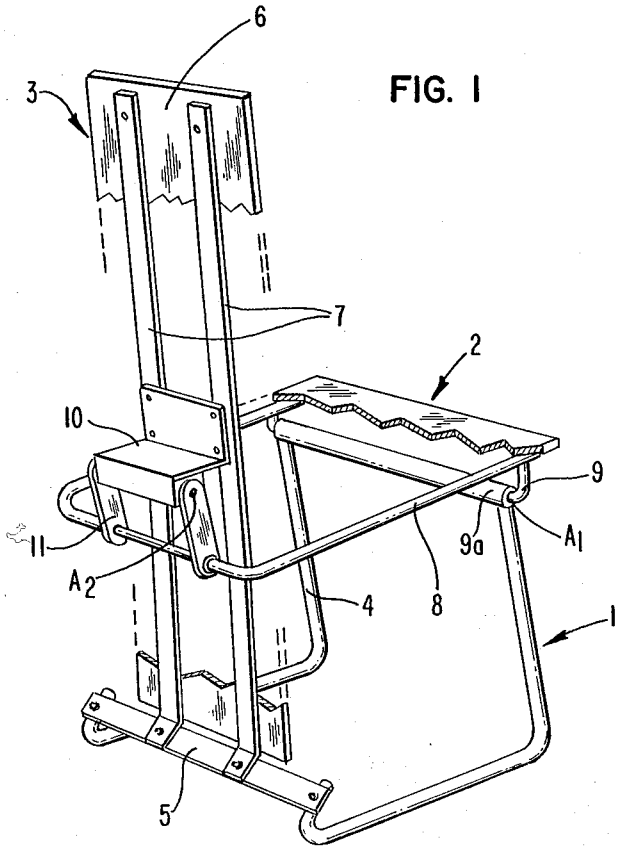
Figure 4:
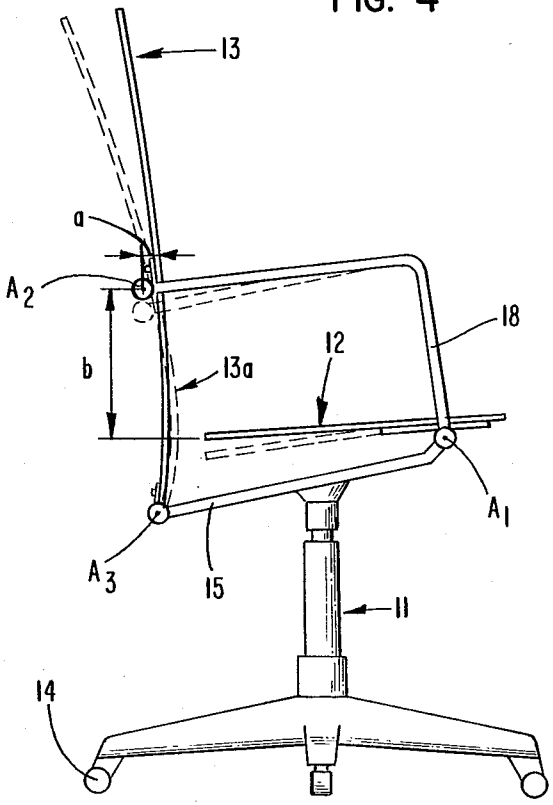
Figure 3:
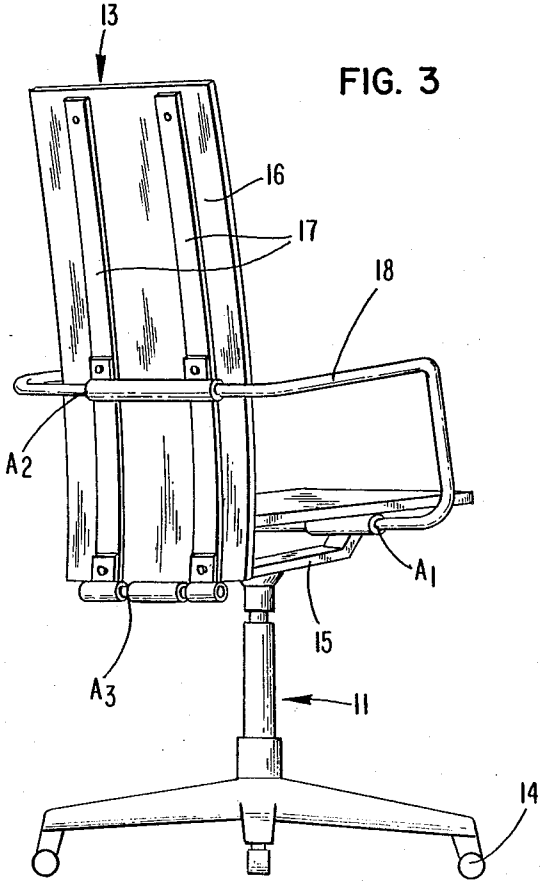

FIG. 1 shows a simplified perspective view of a first embodiment of the seat furniture according to the invention, before the upholstery is attached, FIG. 2 shows a vertical section through this embodiment, FIG. 3 shows a perspective representation of an alternative version, and FIG. 4 shows the corresponding representation in vertical section.

The chair illustrated in FIG. 1, with non-essential details omitted, consists of a stand 1, a seat 2 and a backrest 3. The stand 1 has essentially two approximately rectangularly bent feet 4 which are formed from tubular sections and which carry a first pivot axle A1 on the front side of the chair. In this embodiment, the stand also includes the lower portion **3*a* (FIG. 2) of the backrest 3, this portion 3*a* being connected to the feet 4 via a crossmember 5** and thus forming an integral component of the stand.

In this first embodiment, the backrest 3 is a plastic plate 6 extending over the entire height of the chair and reinforced with two longitudinal steel strips 7 which are fastened flexibly at their lower ends to the crossmember 5. As a result of this construction, the backrest 3 has a specific elastic resilience, so that it yields under load and automatically resumes its original position when relieved. As will also emerge from the following description, this elastic spring effect is necessary, above all in the lower backrest portion **3*a***.

The seat designated as a whole by 2 has a virtually U-shaped frame 8 which, for example, can likewise be produced from a tubular section and which is mounted rotatably in a tubular crossmember 9a by means of two pivoting shackles 9 in the region of the front seat portion and at a distance c from the front edge of the seat. The seat thus forms a kind of two-armed lever with the front lever arm c and the rotary axle A1. As FIGS. 1 and 2 also show, the seat frame 8 engages behind the backrest 3 and on its rear side is connected to the backrest 3 by means of a second pivot axle A2. This second pivot axle A2 on the one hand is fastened rigidly to the rear side of the backrest 3 by means of a bracket 10 and on the other hand, on its two end portions, carries two connecting links 11, on which the rear portion of the seat frame 8 is suspended. The two connecting links 11 are thus mounted rotatably about the axle A2 and perform the function of transmitting any movement of the backrest 3 to the seat frame 8.

The second pivot axle A2 is located at such a vertical distance b from an imaginary horizontal plane passing through the axle A1 that it is approximately level with the lumbar vertebrae of the selected person. Furthermore, there should preferably be a horizontal distance a between the axle A2 and the backrest 3 which can be, for example, between 5 and 20 cm.

The following result is obtained when the chair described is used:

After the seated person has initially remained for a certain time in the vertical sitting position corresponding to the contours of the seat/backrest combination which are represented by unbroken lines in FIG. 2, according to experience he will feel the need to adopt another sitting position by adjusting the backrest 3. If, as normally occurs, a load is exerted on the backrest 3 in the region of the lumbar vertebrae (the arrow B in FIG. 2), as a result of its inherent elasticity it bends rearwards into the position represented by broken lines. At the same time, the axle A2 describes an arc of a circle of radius $A_1$–$A_2$ and lowers the rear seat portion adjacent to the backrest 3 by a corresponding amount. The seated person has thus found a new sitting position which meets ergonomic criteria.

The chair illustrated in FIGS. 1 and 2 is only one possible embodiment which a person skilled in the art can modify in many respects within the scope of the inventive idea. Thus, although it may be advantageous, for the purpose of obtaining a simple design, to lengthen the illustrated backrest 3 downwards in one piece and fasten it to the lower stand element, it would nevertheless also be possible to mount the backrest on the stand approximately level with the seat plane and there either fasten it flexibly to a crossmember or articulate it by means of a further horizontal axle. At all events, however, at least that portion of the backrest 3 which extends from the fastening point of the axle A2 to the lower clamping point of the backrest 3 should be made elastically resilient. An appropriate elastic restoring force can be achieved by producing the backrest 3 from plastic, steel or a combination of different materials.

It must be considered a decisive advantage of the construction described that, on the one hand, the chair makes do with an extremely simple seat/backrest adjustment mechanism requiring no helical springs or pneumatic springs and therefore resulting in a lightweight seat furniture which can be produced cost-effectively, whilst on the other hand the functioning thereby obtained corresponds to an absolutely top-quality solution in terms of sitting comfort.

A modification of the inventive idea is shown in FIGS. 3 and 4, here too the upholstery not being shown for the sake of clarity. In this case also, the three basic units, that is to say a supporting stand 11, a seat 12 and a backrest 13 can be distinguished on the chair. The commercially conventional stand 11 equipped with castors 14 carries a crossmember 15 designed in the form of a steel section and fastened rigidly to the stand top part.

The crossmember 15, at its front edge, carries a pivot axle A1, on which the seat 12 is suspended in such a way that, here too, it can execute a rocking movement about the axle A1 in the manner of a two-armed lever. However, in contrast to the embodiment illustrated in FIGS. 1 and 2, here the long seat portion is cantilevered, that is to say not connected to the backrest.

The backrest 13, which again can consist, for example, of an elastic plastic plate 16 and reinforcing steel strips 17, is anchored at its lower end on the crossmember 15 in such a way that it can pivot about an axle A3 located on the crossmember. Here to, a pivot axle A2 is fastened to the rear side of the backrest 13 at a distance b above an imaginary horizontal plane passing through the axle A1 (corresponding to the position of the lumbar vertebrae) and at a distance a from the backrest itself. An actuating rod assembly 18 engages on this pivot axle A2, extends from the front seat portion on both sides and above the seat and thus at the same time forms, on the one hand, the armrests of the chair, and, on the other hand, the connecting member between the backrest and seat.

The actuating rod assembly 18 comprises two actuating levers which start from the pivot axle A1 and which are fastened on both sides of this rigidly to the underside of the seat. The axle A1 can be, for example, a tube in which the ends of the two actuating levers 18 are mounted rotatably.

In this embodiment too, when a load is exerted on the backrest the latter will be deformed (see the contour represented by broken lines) in such a way that the axle A2 is lowered by a corresponding amount, since it moves over an arc of a circle of radius $A_1$ - $A_2$. This lowering movement of the axle A2 is now transmitted via the armrests 18 to the front seat portion which rises slightly and thereby gives rise to the desired lowering movement of the rear seat portion. The convexity of the backrest in the lower backrest portion 13u (FIG. 4), associated with the bending of the backrest, is absorbed as a result of the arrangement of the axle A3.

The axles A1, A2 and A3 illustrated by means of FIGS. 1 to 4 can be designed in a known way, for example as pivots, hinges, etc., by a person skilled in the art.

I claim:

1. Seat furniture, comprising a stand having a forward section, a rearward section and a first pivot axis located on said forward section at a first elevation; a seat having a front end and a back end; a backrest having an upper end, a lower end fixedly attached to said rearward section of said stand, a front side facing toward said seat, a back side facing away from said seat, and an elastically resilient portion extending from said lower end of said backrest to a point on said backrest located at a second elevation which is higher than said first elevation, said backrest being arranged in a rest position in which said backrest is oriented substantially vertically and said backrest being deflectable out of its said rest position in response to a force exerted against said front face of said backrest by an individual sitting on said seat; connecting means movably mounted on said forward section of said stand for connecting said seat to said backrest in such a manner that said back end of said seat pivots downwardly in response to the deflection of said upper end of said backrest away from said forward section of said stand, said connecting means including an angular linkage extending between said first pivot axis and a second pivot axis positioned adjacent to said back face of said backrest at a third elevation which is higher than said first elevation but no higher than said second elevation, whereby said elastically resilient portion of said backrest is located below said second pivot axis, said linkage including a first end which supports said front end of said seat and which is pivotable about said first pivot axis and a second end which is pivotable about said second pivot axis; and supporting means fixedly attached to said back face of said backrest for supporting said second end of said linkage, said supporting means including said second pivot axis, whereby said second end of said linkage is pivotally connected to said supporting means in such a manner that said second end of said linkage pivots about said second pivot axis as said first end of said linkage pivots about said first pivot axis to thereby permit the synchronous movement of said backrest and said seat.

2. Seat furniture according to claim 1, wherein said first end of said linkage includes a first link member and wherein said second end of said linkage includes a second link member arranged at an angle relative to said first link member and rigidly attached thereto, said second link member extending downwardly from said supporting means, whereby said linkage is suspended from said supporting means.

3. Seat furniture according to claim 2, wherein said first link member extends below said seat on opposite sides thereof.

4. Seat furniture according to claim 2, wherein said first link member extends above said seat on opposite sides thereof, whereby said first link member may also function as armrests for said seat furniture.

5. Seat furniture according to claim 1, wherein said lower end of said backrest is attached to a cross-member bridging a lower end of said stand.

6. Seat furniture according to claim 6 wherein said backrest is pivotable about a third pivot axis which passes through said lower end of said backrest.

7. Seat furniture according to claim 1, wherein said backrest includes an elastically resilient plastic plate reinforced by vertically arranged steel strips.

8. Seat furniture according to claim 1, wherein said second pivot axis is spaced horizontally from said back face of said backrest.

9. Seat furniture according to claim 1, wherein said back end of said seat projects rearwardly from said forward section of said stand in a cantilever-like fashion.

* * * * *